United States Patent [19]

Lerner

[11] Patent Number: 4,632,245

[45] Date of Patent: Dec. 30, 1986

[54] DISPLAY AND TRANSPORT MEDIUM FOR A HAND HELD DEVICE SUCH AS A YO-YO

[75] Inventor: Nathan Lerner, Chicago, Ill.

[73] Assignee: Donald F. Duncan, Tucson, Ariz.

[21] Appl. No.: 697,485

[22] Filed: Feb. 1, 1985

[51] Int. Cl.[4] ..... B65D 85/20

[52] U.S. Cl. ..... 206/315.1; 206/315.9; 224/269; 224/252; 224/247; 446/26; 446/247

[58] Field of Search ..... 206/315.1, 315.9; 224/244, 245, 239, 919, 252, 253, 269, 247, 904; 446/26, 27, 28, 247

[56] References Cited

U.S. PATENT DOCUMENTS

| | | | |
|---|---|---|---|
| 2,548,330 | 4/1951 | Wiseman | 224/245 |
| 2,995,280 | 8/1961 | Thierry | 224/239 |
| 3,146,925 | 9/1964 | Ruderian | 446/28 |
| 3,255,552 | 6/1966 | Salayka | 446/28 |
| 4,062,482 | 12/1977 | Szalony | 224/219 |
| 4,068,785 | 1/1978 | Goudreau | 206/315.9 |
| 4,396,136 | 8/1983 | Stafford, Jr. | 206/315.9 |

*Primary Examiner*—William Price
*Assistant Examiner*—David Fidei
*Attorney, Agent, or Firm*—Kirkland & Ellis

[57] ABSTRACT

One face of a hand held device such as a yo-yo snaps over nubs projecting inwardly from a cavity and held securely in a display and transport medium for a yo-yo. Multiple nubs allow for secure retention of both concave and convex faced yo-yos while permitting unobstructed view of an exposed face of the yo-yo.

2 Claims, 5 Drawing Figures

DISPLAY AND TRANSPORT MEDIUM FOR A HAND HELD DEVICE SUCH AS A YO-YO

BACKGROUND OF THE INVENTION

1. Field of the Invention:

This invention relates generally to displays and transport holders, and in particular to a display and transport medium for a hand held device such as a yo-yo.

2. Description of the Prior Art:

Prior art displays and transport holders for yo-yo's typically consisted of a pouch which could be affixed to some portion of the clothing worn by a user, usually the belt, and were adapted to receive the yo-yo. The yo-yo's would remain in the pouch by action of gravitational forces, but occasionally a flap with a snap or other type of fastner was added to secure the yo-yo against being dislodged from the pouch until desired.

Such prior art holders did not permit for display of the outer surface of the face of the yo-yo during transport, because both faces of the yo-yo were confined within the holder. Because the outer faces of yo-yo's are usually decorated with ornamental designs or indicia, which often play an important role in the purchase and desirability of owning a particular style or brand of yo-yo, it would be advantageous for a holder to allow an outer face of the yo-yo to be exposed to view.

Therefore, a useful, simple and inexpensive holder that would also function as a display for at least one face of a yo-yo would be desirable both to the yo-yo seller and the yo-yo owner. The present invention meets this need.

Thus, one of the objectives of the present invention is to provide a holder for a yo-yo that will hold it securely in place while simultaneously displaying at least one face of the yo-yo to an unobstructed view.

Another object of the present invention is to provide an inexpensive, easily fabricated, secure holder for yo-yo's.

These and other objects of the invention are apparent from the following detailed description of the preferred embodiment of the invention.

DETAILED DESCRIPTION OF THE PREFERRED EMBODIMENT OF THE INVENTION

Figure 1:
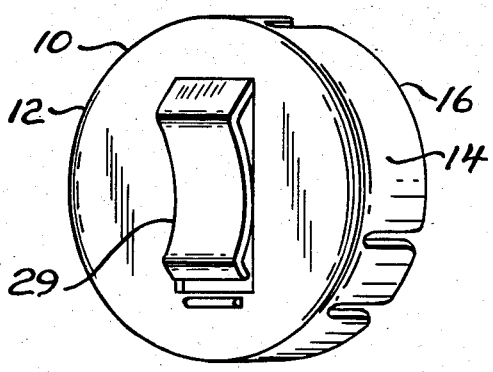
FIG. 1 is a rear perspective view of the preferred embodiment of the invention.
Figure 2:
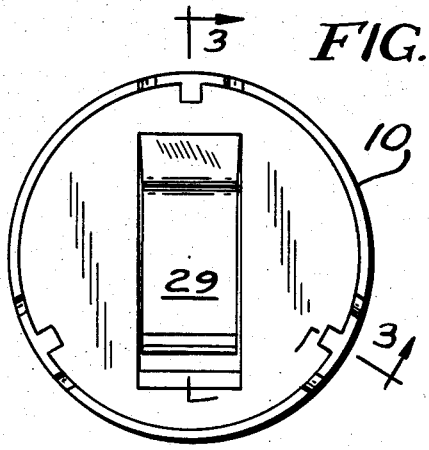
FIG. 2 is a front view of the preferred embodiment of the invention.

As shown in FIGS. 1 and 2, the preferred embodiment of the present invention is a generally semi-hemispherical holder 10, with a generally concave recess in its central portion 12, designed to receive one face of a yo-yo. An upwardly rising wall 14 surrounds and defines the central portion 12 and ends in a rim 16.

Figure 3:
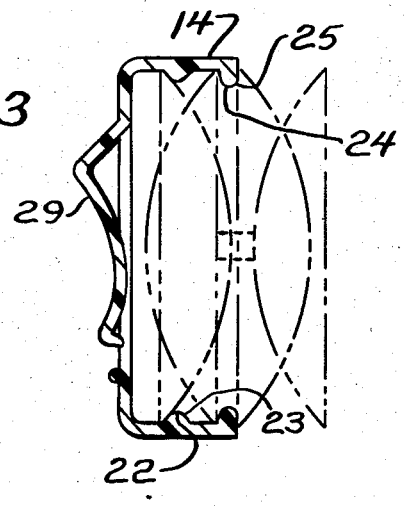
FIG. 3 is a partially cut-away side view of the preferred embodiment of the invention.
Figure 4:
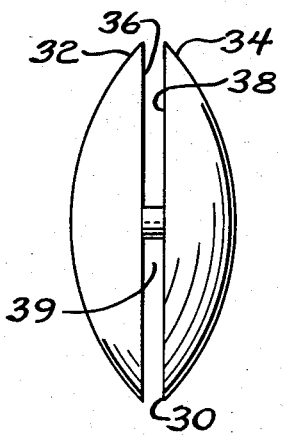
FIG. 4 is a side view of a conventional, convex faced, flat groove type yo-yo.
Figure 5:
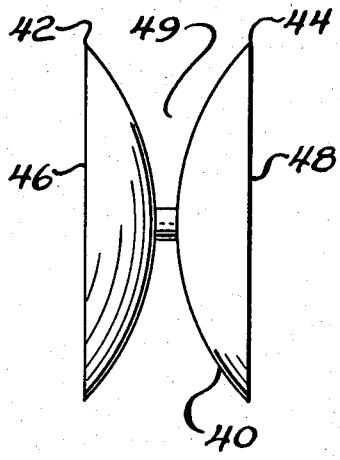
FIG. 5 is a side view of a contemporary, flat faced, concave groove type yo-yo.

As shown in FIG. 3, the upwardly rising wall 14 of the holder 10 also has two inwardly projecting nubs 22 and 24 which reduce the circumference of the cavity at their peaks to a distance slightly less than the outermost diameter of yo-yos 30 (FIG. 4) and 40 (FIG. 5). In operation, numbers 22 or 24 snap over the outermost periphery of yo-yo 30 or 40, respectively, as the yo-yo is pressed into the cavity 12 of holder 10.

Yo-yo's 30 and 40 are representative of the two types of yo-yo's in wide commercial distribution today. Yo-yo 30 (FIG. 4) is the traditional style, with the curved, convex outer surface of its two symetrical halves 32 and 34 pointing outwardly and generally flat surfaces 36 and 38 forming the string receiving through 39. Yo-yo 40 (FIG. 5) is representative of a more contemporary style, with the curved, concase surface of its two symetrical halves 42 and 44 forming the string receiving trough 49, and generally flat portions 46 and 48 forming the outer faces. It should be understood that variations on these shapes are possible, and can also be used with the present invention.

When a yo-yo is pressed into the face receiving cavity 12 of holder 10, the one of the outwardly facing surfaces 23 and 25 forming nubs 22 and 24, respectively, acts as a land for causing wall 14 to expand sufficiently to permit the outermost periphery of the yo-yo to fit within the inwardly facing surface of nubs 22 and 24. Preferably holder 10 is constructed of a resilient substance, such as thermoplastic, which can expand and then regain its original shape. Thus, the outermost periphery of one face of yo-yo 30 and 40 "snaps" into place within nubs 22 or 24 as the face of the yo-yo is pressed into cavity 12.

To remove the yo-yo from holder 10, the user need only gently pull outwardly on the outer face of the yo-yo. The inwardly facing surfaces forming nubs 22 and 24 also act as lands to expand the circumference of wall 14 to allow the outermost periphery of the captured face of the yo-yo to pass through the inner circumference defined by the radially inward peaks of nubs 22 and 24.

While the yo-yo is secured in holder 10, its outer face is displayed and unobstructed.

The back wall of cavity 12 in holder 10 preferrably includes one or more protrusions 29 adapted to hook onto a belt, pant top, or the like, as shown in FIGS. 1 and 2. Protrusion 29 is preferrably integral with the material of holder 10 and is formed simultaneously therewith.

The preferred substance for constructing holder 10 is thermoplastic. Holder 10 can be easily and inexpensively molded from thermoplastic or other inexpensive, moldable, deformable materials by well-known methods.

It should be understood that various modifications, changes and variations may be made in the shape, operation and details of construction of the elements disclosed herein without departing from the spirit and scope of this invention as defined in the claims.

I claim:

1. A display and transport medium for a yo-yo, comprising:

a face receiving cavity defined by one or more outwardly projecting wall members;

an outer circumferential nub located near the outer edge of said cavity and projecting radially inwardly from said wall members, said outer nub defining a circumference somewhat less than the outermost circumference of one face of a convex face, flat groove type yo-yo and adapted to snap over the outermost circumference of said convex yo-yo face;

an inner circumferential nub located along the surface of said wall members inwardly of said outer nub and projecting radially inwardly from said wall members, said inner nub defining a circumference somewhat less than the outermost circumference of one face of a flat faced, concave groove type yo-yo and adapted to snap over the outermost circumference of said flat yo-yo face; and a hook-like projection extending outwardly from said cavity for attachment to a carrier and disposed such that the medium is oriented in a vertical plane and the opening of the face receiving cavity faces essentially in a horizontal plane.

2. The medium as claimed in claim 1, wherein said medium is constructed of plastic.

* * * * *